United States Patent [19]

Butoi

[11] 4,092,744

[45] June 6, 1978

[54] AUTOMATIC HYGIENIC WASHING MACHINE

[76] Inventor: Aristotel Butoi, 689 Seneca Ave., Ridgewood, N.Y. 11227

[21] Appl. No.: 770,441

[22] Filed: Feb. 22, 1977

[51] Int. Cl.[2] ..... A61H 35/00; A46B 13/06; G05G 9/04

[52] U.S. Cl. ..... 4/7; 15/21 E; 15/24; 74/471 XY

[58] Field of Search ..... 4/1, 6, 7, 158, 182, 4/184, 185 R; 128/56, 66; 15/24; 74/471 XY; 15/21 E

[56] References Cited

U.S. PATENT DOCUMENTS

| | | | |
|---|---|---|---|
| 1,521,892 | 1/1925 | Koppin | 4/7 |
| 1,641,494 | 9/1927 | Joseph | 15/24 |
| 1,999,799 | 4/1935 | Beck et al. | 4/184 |
| 2,605,477 | 8/1952 | Monserrat | 4/7 |
| 2,929,073 | 3/1960 | Sarlin | 4/184 X |
| 3,513,487 | 5/1970 | Palermo et al. | 4/7 |
| 3,599,267 | 8/1971 | Faires | 15/24 |
| 3,797,481 | 3/1974 | Doran | 4/1 X |
| 4,014,355 | 3/1977 | DiMatteo et al. | 4/7 |

*Primary Examiner*—Houston S. Bell
*Assistant Examiner*—Stuart S. Levy
*Attorney, Agent, or Firm*—Richard L. Miller

[57] ABSTRACT

An apparatus mountable on a toilet so to wash and clean an individual's private parts; the apparatus including a rotatable brush powered by water, and the brush additionally spraying water so to wash while the brush gently scrubs; the brush being fully adjustable in position by a handle located alongside the toilet, the brush being movable into a stored, out-of-the-way position between the toilet seat and the bowl when not in use so to allow the toilet for other uses, and the apparatus including a water tank containing an electric heater so to heat the water that washes the person.

2 Claims, 8 Drawing Figures

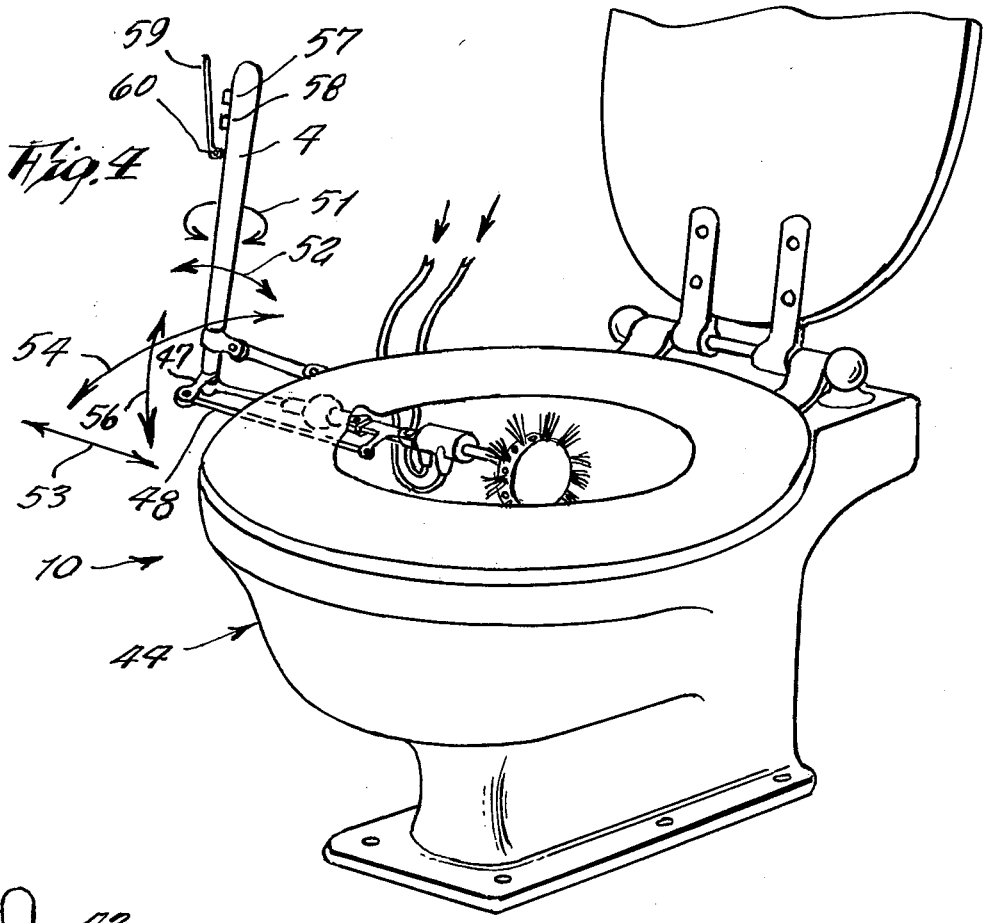
Fig. 4
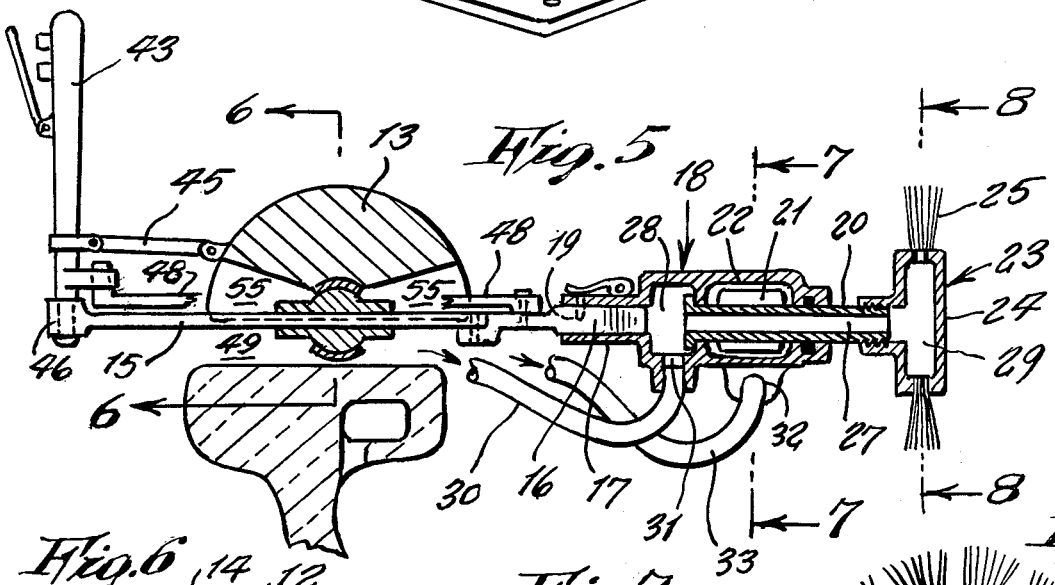
Fig. 5
Fig. 6
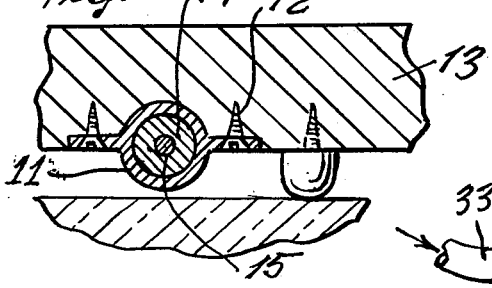
Fig. 7
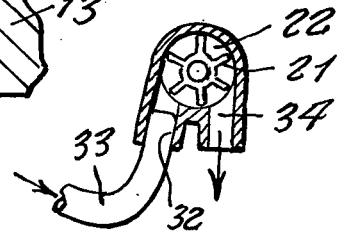
Fig. 8
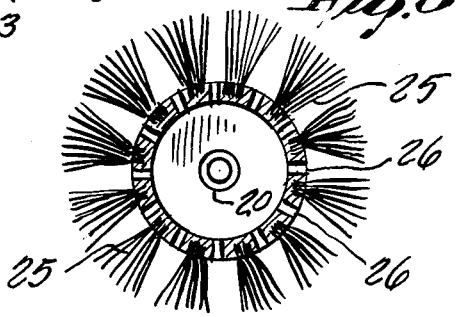

AUTOMATIC HYGIENIC WASHING MACHINE

This invention relates generally to apparatus attachable to a bathroom toilet. More specifically it relates to washing and scrubbing devices.

A principal object of the present invention is to provide an apparatus attachable to a toilet tank so a person could wash and gently scrub the private parts so to be hygienically clean.

Another object is to provide a hygienic washing machine that can be used by both men and women so to clean the sex organs as well as the anus region.

Yet a further object is to provide a hygienic washing machine which is operative while a person sits on the toilet, and which does not splash any water outside of the toilet bowl and which operates quickly.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 4 is a perspective view of the invention.

FIG. 5 is a cross section on line 5—5 of FIG. 2.

FIG. 6 is a cross section on line 6—6 of FIG. 5.

FIG. 7 is a cross section on line 7—7 of FIG. 5.

FIG. 8 is a cross section on line 8—8 of FIG. 5.

Figure 1:
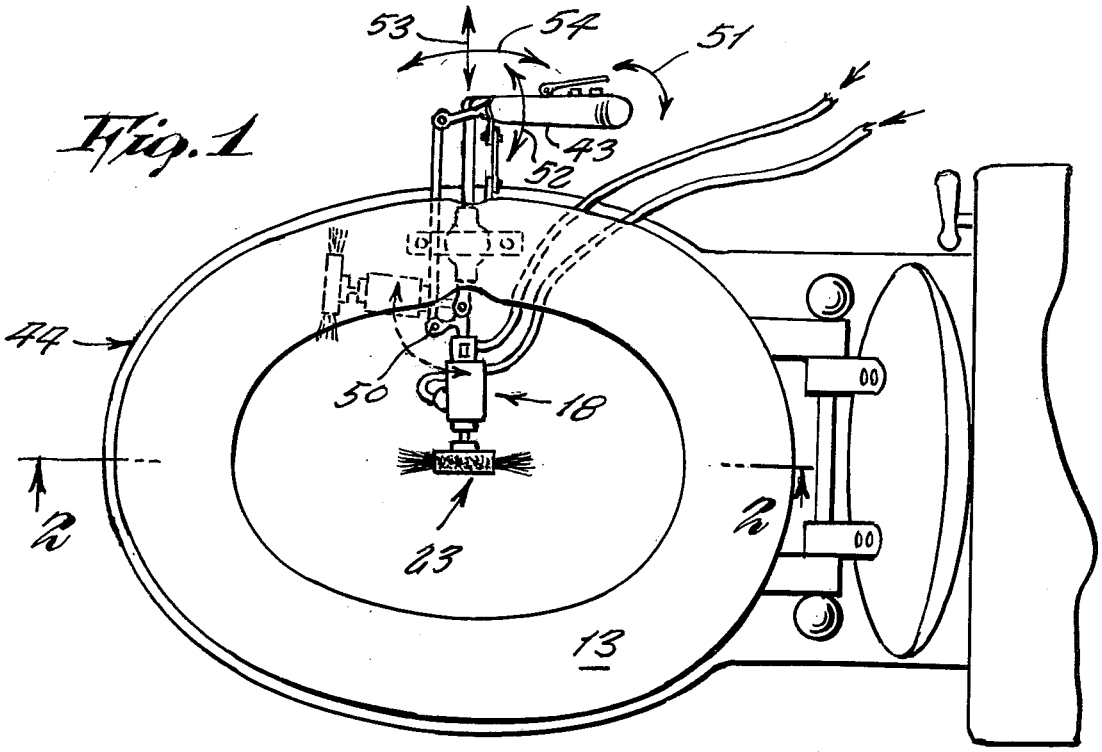
FIG. 1 is a top view of the invention installed on a toilet.
Figure 2:
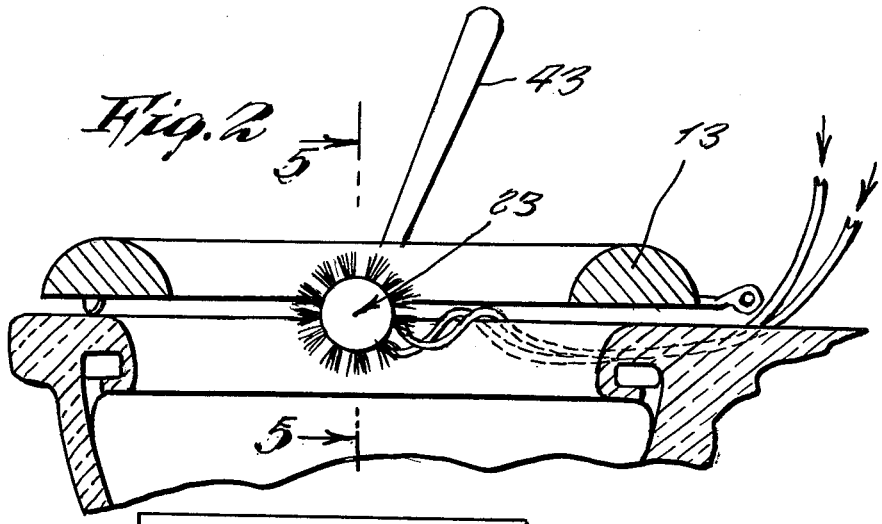
FIG. 2 is a cross section on line 2—2 of FIG. 1.
Figure 3:
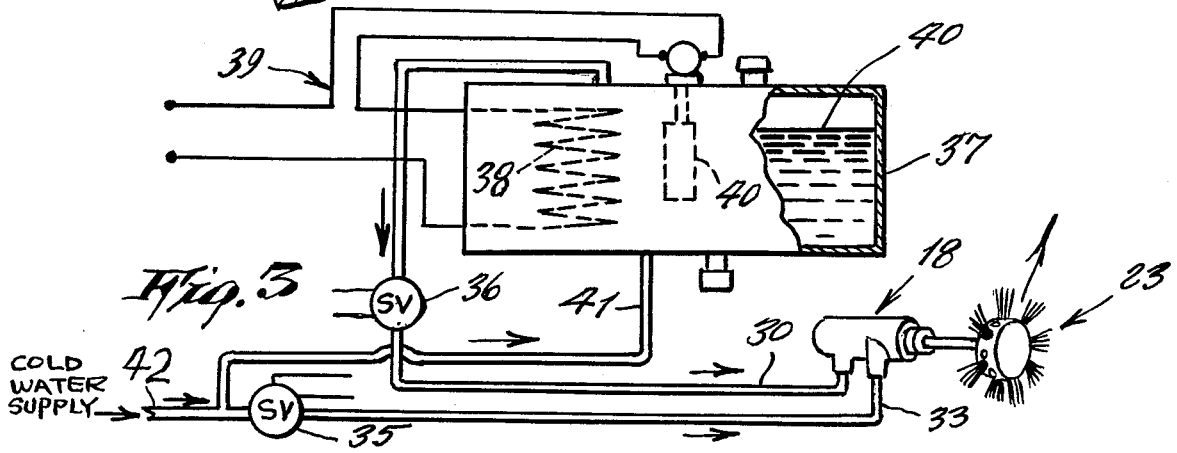
FIG. 3 is a water circuit diagram thereof.

Referring now to the drawings in greater detail, the reference numeral 10 represents an automated hygienic washing machine according to the present invention wherein there is a bracket 11 secured by screws 12 mounted on an underside of a toilet seat 13, the bracket having a spherical surface so to retain a spherical ball shaped portion of a pipe 14 and allow it to universally pivot. A rod 15 is slidable in a central opening of the pipe, one end of the rod being connected pivotally to one end of a shank 16 which at its other end is detachably inserted into a case 17 of a power unit 18, and is secured therein by a spring-biased pin 19.

The power unit 18 supports a rotatable shaft 20 having fins 21 in a chamber 22 of the case 17. One end of the shaft protrudes outward of case 17 and is threaded so a brush 23 can be detachably secured thereto.

The brush 23 includes a hollow, circular base 24 from a periphery of which brush bristle tufts 25 extend radially, and the peripheral wall of the base 24 is perforated with openings 26.

The shaft 20 has a central opening 27 therethrough so that a water chamber 28 inside the case 17 can communicate with the chamber 29 inside the brush hollow base. A flexible hose 30, connected to entry port 31 of the chamber 28, supplies it with warm water.

The chamber 22 of the case 17 has an entry port 32 to which a flexible hose 33 is connected for supplying it with unheated water. An outlet port 34 allows the water to run out of the chamber 22 after having served to push against the fins 21 so to rotate the shaft 20.

Thus unheated water is used to rotate the brush, while heated water is dispensed by the brush so to wash a person's private parts while the brush bristles gently scrub same.

The hose 33 is connected to a valve 35 along a cold water supply line of a house. The hose 30 is connected through valve 36 to a heated water supply tank 37 containing an immersed water heating element 38 located in an electrical circuit 39 that includes a thermostat 40 for automatically turning the circuit on or off in order to maintain water 40 in the tank at approximately a body temperature. A water supply line 41 refills the tank 37 from the house cold water supply shown at 42.

In order that the brush 23 can be precisely positioned so to clean the body private parts, the brush can be moved in any direction by means of a control lever 43 located along a side of the toilet 44. A longitudinal intermediate portion of the control lever is pivotally tethered to one end of a first link 45 which at its other end is pivotally supported on the toilet seat 13. The lower end of the lever 43 is rotatable in an opening 46 in the end of the rod 15. A sideward extending spur 47 formed near a lower end of the lever 43 is pivotally attached to one end of a second link 48 which passes through a space 49 formed between the underside of the toilet seat and the toilet 44, the opposite end of the link 48 being pivotally attached to a sideward extending spur 50 formed on the shank 16. Thus rotation of the lever is indicated by arrow 51 in FIGS. 1 and 4 causes the brush to be pivoted from the operating position shown by solid lines in FIG. 1 to the non-operative, stored away position shown by the dotted lines in the same figure. The underside of the toilet seat can be notched out at this point so that the brush can completely fit into this notch and thus be fully out of the way so that the toilet bowl can be used for normal other purposes.

When the lever 43 is pivoted as shown by arrow 52 in FIGS. 1 and 4, it causes the rod to slide as shown by arrow 53 in the same figures so that the brush is moved toward either side.

When the lever is pivoted horizontally forward or rearward as shown by arrow 54 of FIGS. 1 and 4, the brush is moved inversely rearwardly or forwardly.

The spherical ball 14 and its corresponding shaped bracket 11 allows the rod 15 to pivot a limited distance into any universal direction, being limited only by the size of the space 49. Accordingly, the toilet seat includes additional notches 55 on inner and outer sides so to increase the limits of such pivotal travel up or down as indicated by arrow 56 in FIG. 4.

It will now be apparent that the brush position is thus fully adjustable so to be used for sex organ or anus cleaning.

Two push buttons 57 and 58 on an upper handle portion of the lever 43 can be simultaneously pushed by an arm 59 pivotable about a pivot pin 60; the push buttons operating electrical circuits for opening or closing the valves 35 and 36.

Thus an automatic hygienic washing machine is disclosed.

While certain novel features of this invention have been shown and described and are pointed out in the annex claims, it will be understood that varius omissions, substitutions and changes in the forms and details of the device illustrated and in its operation can be made by those skilled in the art without departing from the spirit of the invention.

What is claimed is:

1. An automatic hygenic washing machine, comprising in combination, a bracket mounted under a toilet seat, spherical ball retained freely rotatable in said bracket, a rod slidable through said ball, one end of a shank being pivotally connected to one end of said rod, a power unit being detachably supported by one of opposite end of said shank, a rotating brush detachably being supported on said power unit; said brush comprising a hollow flat, circular base having bristle tufts on a periphery thereof and openings on said periphery communication with an interior chamber of said base; said power unit including a case having a first chamber, a tubular shaft rotated in bearings of said case extending through said first chamber, a plurality of radials fins formed around an outer side of said shaft first chamber, an entry port and an outlet port from a cold water supply being connected to said entry port so that flow of said water through said first chamber cause said shaft to rotate, a second chamber inside said power unit case communicating with one end of a central opening through said shaft, said brush mounted upon an opposite end of said shaft, an interior of said base communicating with an opposite end of said shaft central opening, a plurality of perforated openings through a peripheral wall of said extending brush bristle tufts around said base; an entry port on said second chamber, a flexible hose from a heated water supply being connected to said second chamber entry; a first link pivoted at one end to said toilet seat, a control lever adjacent a side of a toilet being tethered to an opposite end of said link, a lower end of said lever being rotatable in an opening on an opposite end of said rod, a sideward spur near a lower end of said lever, and a second link being pivotally connected to said spur, said second link being also connected to a sideward spur formed along an intermediate portion of said shank.

2. The combination as set forth in claim 1, wherein a valve is provided along each water line of said hoses leading to said first and second chambers, and a pair of switch push buttons on an upper handle portion of said lever, said valves and said switch push buttons being in electrical circuits for opening or closing said valves.

* * * * *